US011772757B2

(12) United States Patent
Seltzer et al.

(10) Patent No.: US 11,772,757 B2
(45) Date of Patent: Oct. 3, 2023

(54) BOAT ANCHOR MONITORING SYSTEM

(71) Applicants: Richard A. Seltzer, Knoxville, TN (US); Granvil Radcliffe, Knoxville, TN (US)

(72) Inventors: Richard A. Seltzer, Knoxville, TN (US); Granvil Radcliffe, Knoxville, TN (US)

( * ) Notice: Subject to any disclaimer, the term of this patent is extended or adjusted under 35 U.S.C. 154(b) by 0 days.

(21) Appl. No.: 17/764,258

(22) PCT Filed: Dec. 29, 2021

(86) PCT No.: PCT/US2021/065429
§ 371 (c)(1),
(2) Date: Mar. 28, 2022

(87) PCT Pub. No.: WO2022/150214
PCT Pub. Date: Jul. 14, 2022

(65) Prior Publication Data

US 2023/0202625 A1 Jun. 29, 2023

Related U.S. Application Data

(60) Provisional application No. 63/135,705, filed on Jan. 10, 2021.

(51) Int. Cl.
*B63B 45/04* (2006.01)
*B63B 21/24* (2006.01)
(Continued)

(52) U.S. Cl.
CPC ..... *B63B 45/04* (2013.01); *B63B 21/24* (2013.01); *B63B 79/10* (2020.01); *B63B 79/40* (2020.01)

(58) Field of Classification Search
CPC ..... B63B 45/04; B63B 21/24; B63B 79/10; B63B 79/40
See application file for complete search history.

(56) References Cited

U.S. PATENT DOCUMENTS 4,714,914 A 12/1987 Boe
4,912,464 A * 3/1990 Bachman ..... B63B 21/22 367/141
(Continued)

FOREIGN PATENT DOCUMENTS

EP 0174189 3/1986
ES WO-2015144954 A1 * 10/2015 ..... B63B 21/22

OTHER PUBLICATIONS

Babić, Anja, et al. "A novel paradigm for underwater monitoring using mobile sensor networks." Sensors 20.16 (2020): 4615. (Year: 2020).*
(Continued)

*Primary Examiner* — Russell Frejd
*Assistant Examiner* — Ana D Thomas
(74) *Attorney, Agent, or Firm* — Stephen Kepper; Intellectual Property Consulting, L.L.C.

(57) ABSTRACT

A boat anchor monitoring system is disclosed and includes a status indicator and an anchor module that are operable to communicate with a base module. The anchor module includes a transmitter operable to transmit a signal containing a data payload on a set schedule. The base module on the boat is operable to determine if the signal strength exceeds, or is equal to a predetermined threshold value, in order to direct the status indicator to either display the anchor in a "Deployed" or "Not Deployed" position. The system may further include a time measurement component or water contact sensor that will direct the indicator to display the anchor in a deployed position if sufficient time has elapsed with no signal or the anchor module has contacted water. The system is also configured to prevent ignition if the anchor is determined to be deployed.

23 Claims, 14 Drawing Sheets

(51) Int. Cl.
*B63B 79/40* (2020.01)
*B63B 79/10* (2020.01)

(56) References Cited

U.S. PATENT DOCUMENTS

| | | | | |
|---|---|---|---|---|
| 6,374,765 | B1 * | 4/2002 | Marotta | B65H 61/00 114/293 |
| 2003/0128138 | A1 * | 7/2003 | Grunder | B63B 21/00 340/539.1 |
| 2015/0116496 | A1 | 4/2015 | Ottaviano et al. | |
| 2016/0180721 | A1 * | 6/2016 | Otulic | B63H 25/02 701/2 |
| 2019/0072951 | A1 * | 3/2019 | Clark | A01K 97/00 |
| 2019/0217924 | A1 | 7/2019 | Frizlen | |

OTHER PUBLICATIONS

Burke, Ben G. "A vessel motion instrumentation system." Journal of Petroleum Technology 18.09 (1966): 1041-1046. (Year: 1966).*

Saasen, A., et al. "Anchor Handling and Rig Move for Short Weather Windows During Exploration Drilling, paper SPE 128442 presented at the 2010 IADC." SPE Drilling Conference and Exhibition held in New Orleans, Louisiana, USA. 2010. (Year: 2010).*

Zheng, Zhongqiang, et al. "Dynamics of anchor last deployment of submersible buoy system." Journal of Ocean University of China 15 (2016): 69-77. (Year: 2016).*

Tjøm, Kyrre J., et al. "Optimized anchor-handling operations in environmentally sensitive areas." SPE Annual Technical Conference and Exhibition. OnePetro, 2010. (Year: 2010).*

Schwartz, Arnold, and Philip M. Chen. "Feasibility Of a Lightweight Buoy Mooring Concept." Offshore Technology Conference. OnePetro, 1972. (Year: 1972).*

Rodriguez, Kari; International Search Report of the International Search Authority (USPTO) for PCT/US21/65429.

Rodriguez, Kari; Written Opinion of the International Search Authority (USPTO) for PCT/US21/65429.

* cited by examiner

BOAT ANCHOR MONITORING SYSTEM

RELATED APPLICATIONS

This application claims priority to U.S. Provisional Patent Application No. 63/135,705, filed Jan. 10, 2021. The entire contents of the above application are hereby incorporated by reference as though fully set forth herein.

FIELD

The present invention relates in general to boat anchor monitoring systems. More specifically, the present invention relates to a system that aids in preventing boats from getting underway while anchors are deployed.

BACKGROUND

When a boater has a need to hold a boat in a fixed position when not in close proximity to a boat dock, the boater will typically employ an anchor. The stay in the fixed position may be short, to work a fishing spot or allow a family to swim, or it may be for an extended period of time, such as an overnight stay.

There are many types of anchors, affixed to the boat with some combination of rope and chain. From this point forward, this rope and chain combination will simply be referred to as an "anchor chain." The size of the boat, bottom structure, and depth of the water all play a part in the choice of anchor type, rope-chain mix, and anchor chain length.

While the anchor deployment provides for the safety of the boat and those on board by not allowing the boat to drift into harm's way, it can also add a safety risk. It is possible for the boat captain to forget the anchor is deployed, either due to forgetfulness or distraction. If the boat is underway while the anchor is deployed, a life-threatening and/or property-threatening situation can occur. A best-case scenario is for the anchor to drag until the drag is noticed and the situation is remedied. The next scenario in order of severity is an anchor chain or anchor chain connection point failure. This will cause property damage and/or loss, but spare human injury or loss of life. The worse-case scenario is for the rope component of the anchor chain to stretch until the point where the anchor breaks free and slingshots into or over the boat. If a person is in the path of the anchor, bodily damage or even death can occur due to the speed and weight of the projectile.

Accordingly, there is a need for a system that alerts the boat operator that one or more anchors are still deployed before starting the ignition and getting underway.

Various "anchor alarm" systems have been realized throughout the years; however, these "anchor alarm" systems are targeted at anchor slippage awareness. This awareness is necessary to prevent the boat from drifting into harm's way while anchored. While critical to the safety of the boat and passengers during periods of anchor, these "anchor alarm" applications do not help prevent a boat operator from starting the ignition and getting underway while an anchor is still deployed. Indeed, for these existing "anchor alarm" systems, the boat operator may not be made aware of the danger until it is too late, as the boat is already underway before any warning is issued.

BRIEF SUMMARY OF THE INVENTION

It is the object of this invention to provide a boat anchor monitoring system that alerts the boat operator that an anchor is deployed in real time and prior to starting the ignition.

In a preferred embodiment, the boat anchor monitoring system includes a status indicator and anchor module that are both operable to communicate with a base module. The anchor module is coupled to a boat anchor and comprises a transmitter operable to transmit a signal on a set schedule. The signal includes a data payload having an identifier value corresponding to the anchor module. The base module is located on the boat and includes a receiver and a processor. The receiver is operable to receive the signal from the transmitter and the processor is operable to determine the strength of the signal and compare the strength of the signal to a predetermined value. If the strength of the signal exceeds, or is equal to, the predetermined value, the processor determines the anchor is not deployed and directs the status indicator to display the anchor in the "not deployed" position. If the strength of the signal is less than the predetermined value, the processor determines the anchor is deployed and directs the status indicator to display the anchor in the "deployed" position. As an option, the predetermined value can be set to the minimum value required for the signal to be detected by the receiver.

In yet another embodiment, the boat anchor monitoring system may further include a timer that is operable to communicate with the base module. The timer is preprogrammed with a threshold time value and is automatically reset by the processor when the strength of the received signal exceeds, or is equal to, the predetermined value. The processor then directs the status indicator to display the anchor in the not deployed position. If no signal is received by the base module that exceeds, or is equal to the predetermined value, and the timer reaches its threshold time value, the processor directs the status indicator to display the anchor in the deployed position.

In yet another embodiment, the boat anchor monitoring system may further include a sensor positioned on the anchor module. The sensor is operable to communicate with the transmitter of the anchor module. The sensor is configured to be activated when the anchor is submerged in water. For this embodiment, the data payload of the signal sent from the transmitter includes a water contact state indication that is set to active when the sensor is activated and inactive when the sensor is not activated. When the base module receives the signal with the water contact state indication set to active, the processor directs the status indicator to display the anchor in the deployed position.

In another embodiment, the base module of the boat anchoring system is further operable to communicate with an ignition system for the boat. For this embodiment, the processor of the base module is operable to determine if the ignition system is activated. If the processor determines the anchor is deployed and the ignition system is activated, the base module will either prevent activation of the ignition system, or alternatively, activate a second indicator alerting the boat operator of the danger of starting the engine while an anchor is deployed.

For any of the embodiments, a plurality of anchor modules coupled to separate anchors may be included. Each anchor module would have its own identifier value, and if the base module determines any one of the plurality of anchors is deployed, the processor of the base module is operable to direct the status indicator to display the anchor in the deployed position, or in the event the base module is communicatively coupled to the ignition system, either prevent activation of the ignition system or activate a second indicator.

BRIEF DESCRIPTION OF THE DRAWINGS

The foregoing and other objects, features, and advantages of the invention are apparent from the following detailed description taken in conjunction with the accompanying drawings in which like parts are given like reference numerals and, wherein.

Figure 1:
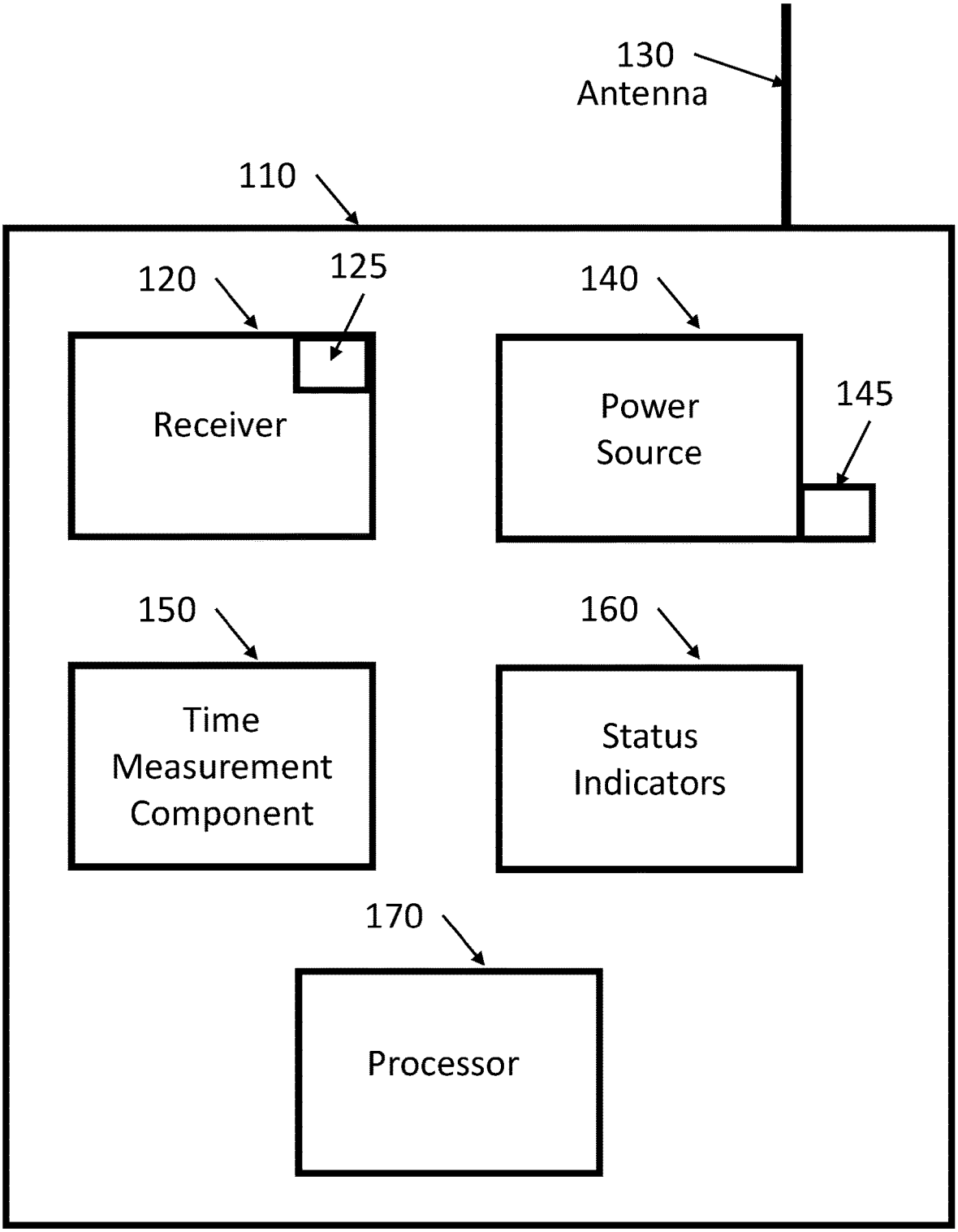
FIG. 1 depicts the base module in accordance with the embodiments of the boat anchor monitoring system.
Figure 2:
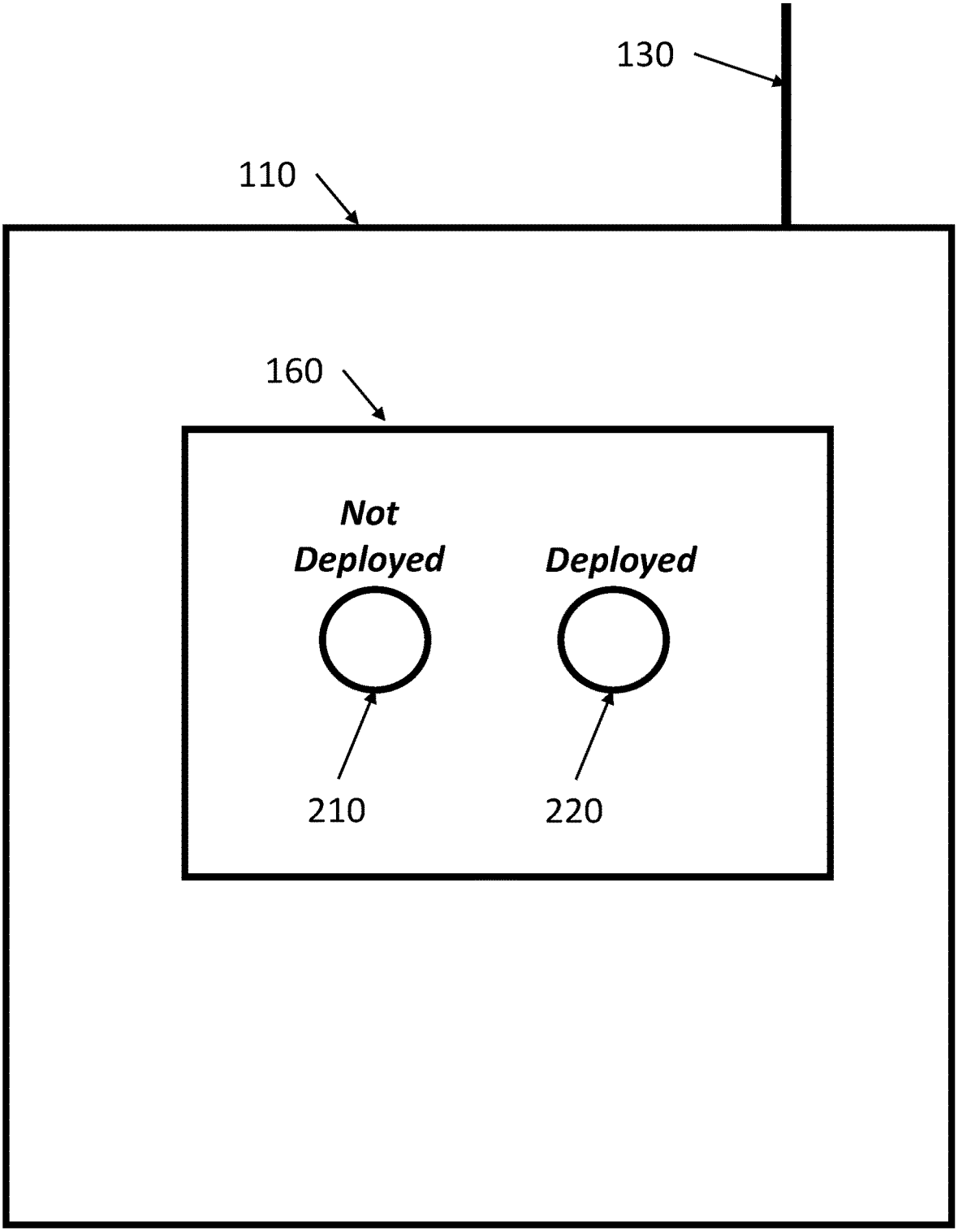
FIG. 2 depicts the status indicator in accordance with the embodiments of the boat anchor monitoring system.

The images in the drawings are simplified for illustrative purposes and are not depicted to scale. Within the descriptions of the figures, similar elements are provided similar names and reference numerals as those of the previous figure(s). The specific numerals assigned to the elements are provided solely to aid in the description and are not meant to imply any limitations (structural or functional) on the invention.

The appended drawings illustrate exemplary configurations of the invention and, as such, should not be considered as limiting the scope of the invention. It is contemplated that features of one configuration may be beneficially incorporated in other configurations without further recitation.

DETAILED DESCRIPTION

For a further understanding of the nature and function of the embodiments, reference should be made to the following detailed description.

Figure 4:
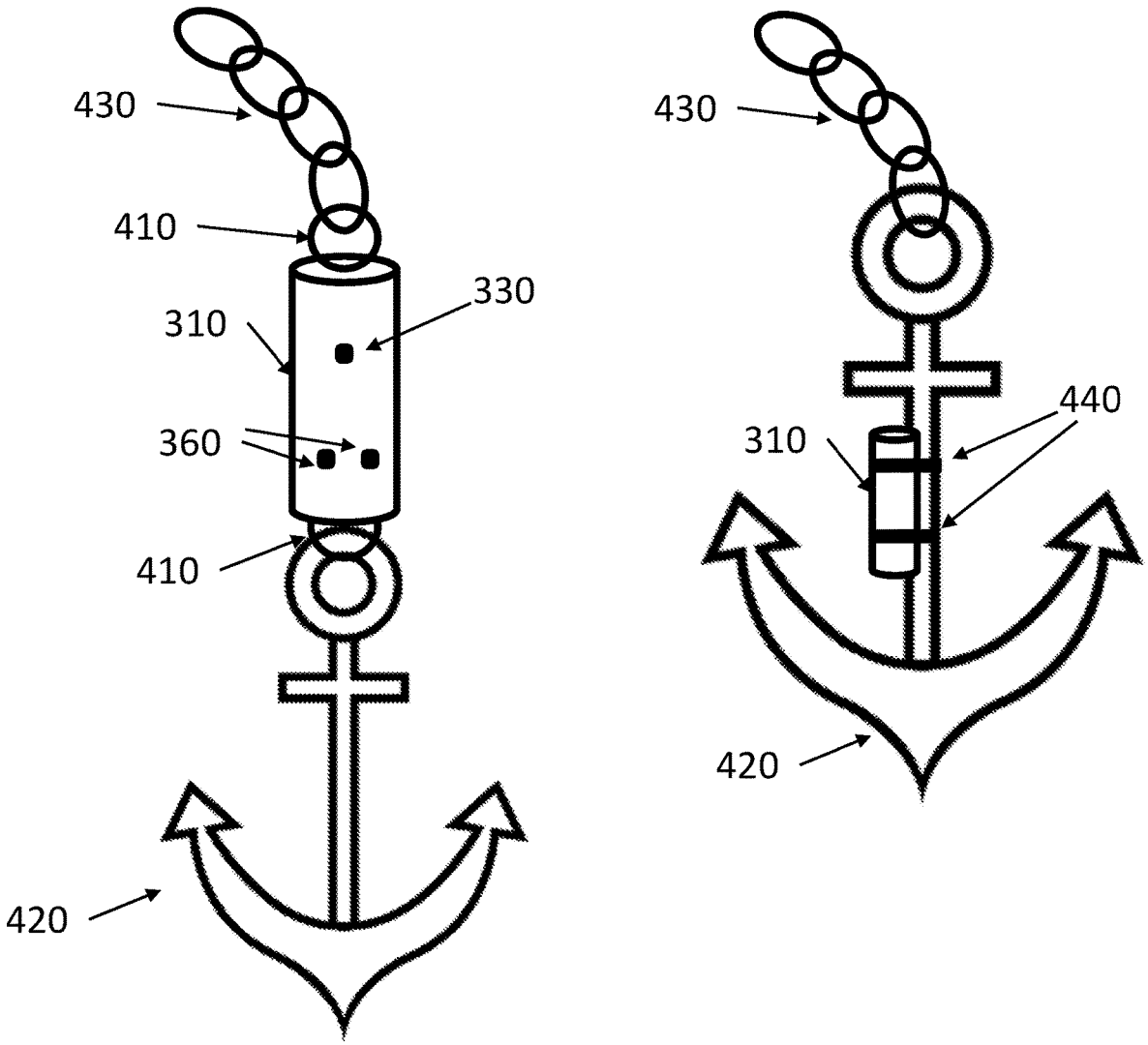
FIG. 4 shows the anchor module attached to an anchor chain and anchor.
Figure 10:
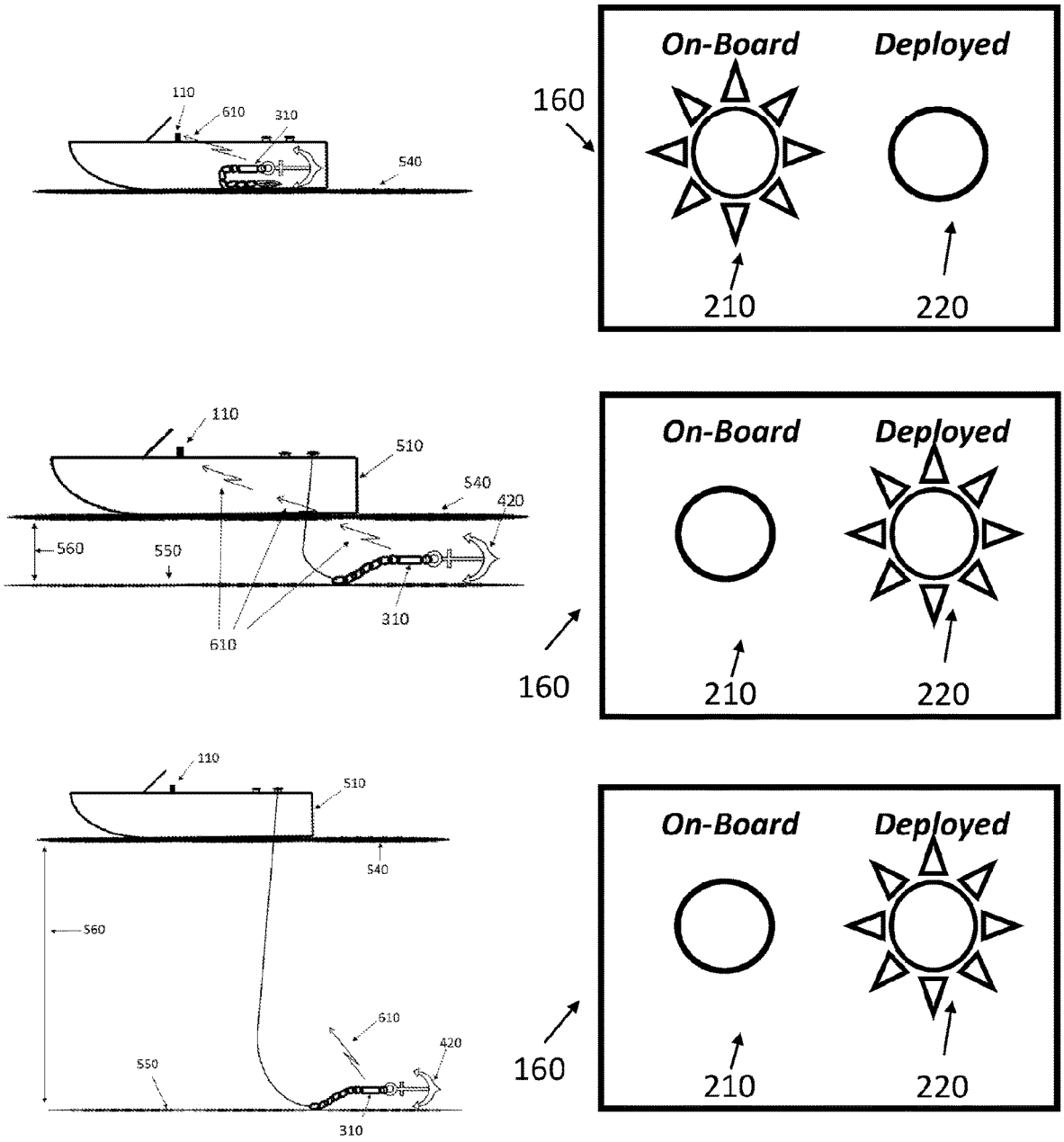
FIG. 10 depicts the status indicator on the base module showing the various states of the anchor module as depicted in FIGS. 6-8.

The boat anchor monitoring system comprises an anchor module 310, a base module 110, and at least one status indicator 160 (as shown in FIGS. 1 and 10). The anchor module 310 is coupled to an anchor 420 or anchor chain 570 (as shown in FIGS. 4-5) and the base module 110 is mounted to or positioned onboard a boat.

Figure 3:
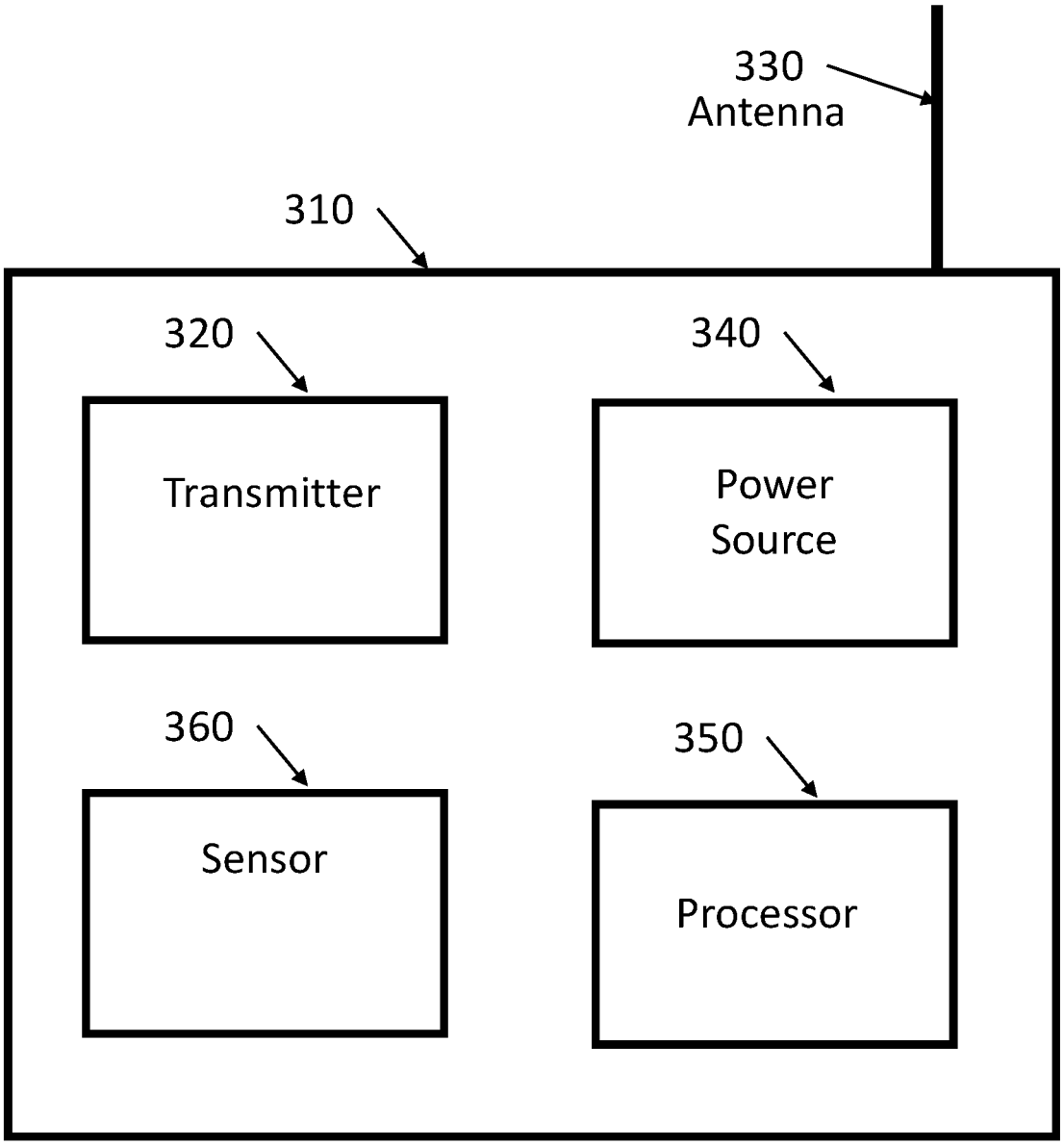
FIG. 3 depicts the anchor module in accordance with the embodiments of the boat anchor monitoring system.

Turning to FIG. 3, the anchor module 310 comprises a power source 340, a processor 350, a transmitter 320, and an antenna 330, which may be a radiofrequency transmitter and antenna, or its equivalent. The processor 350 is operable to communicate with the transmitter 320. The transmitter 320 is operable to transmit a signal 610, e.g. a radiofrequency signal, comprising a data payload 910, which includes an identifier value 930 corresponding to that particular anchor module 310.

Figure 5:
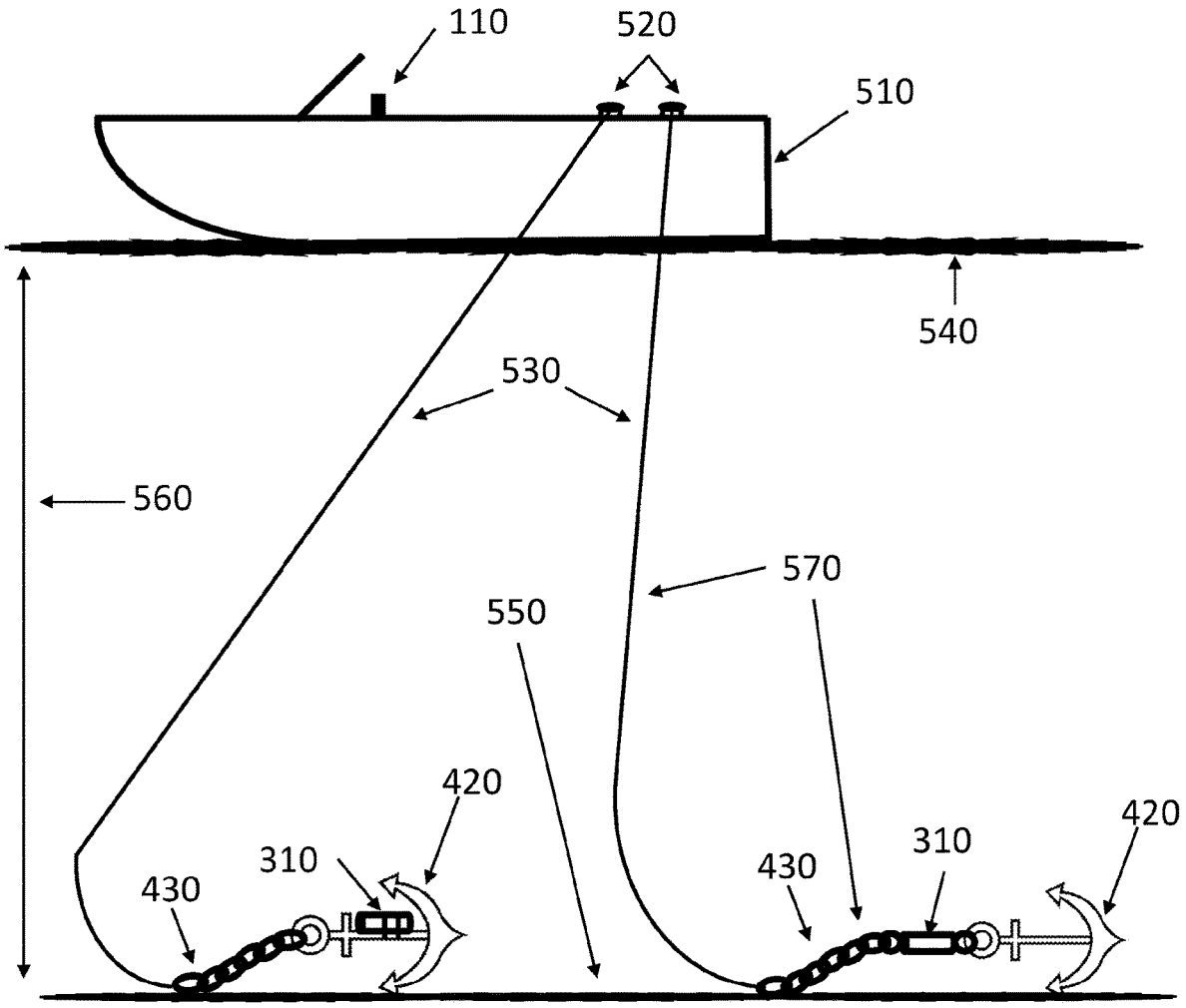
FIG. 5 depicts the boat anchor monitoring system showing the base module and anchor module in a deployed position.
Figure 6:
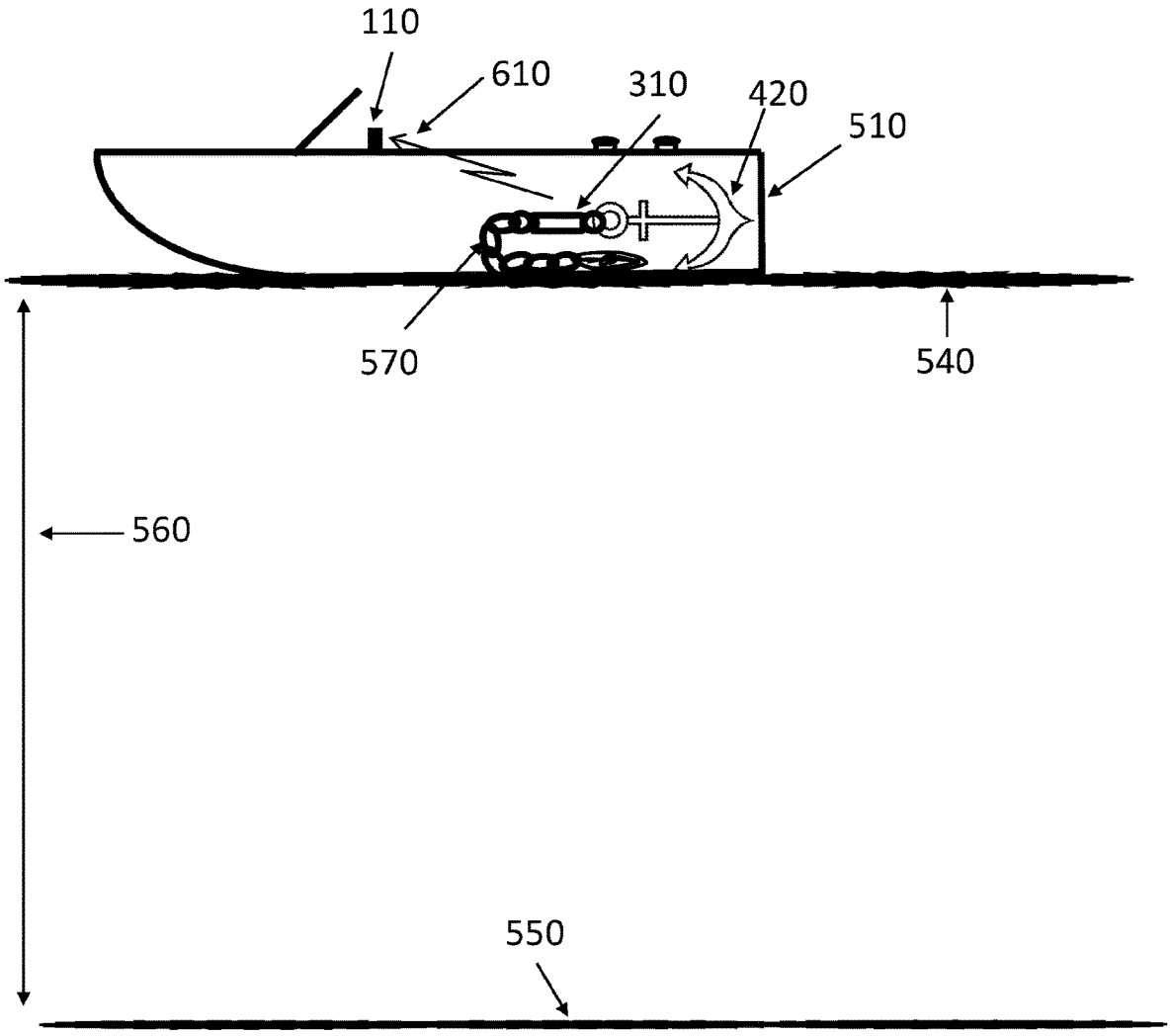
FIG. 6 depicts the boat anchor monitoring system showing the base module and anchor module in a not deployed position.
Figure 7:
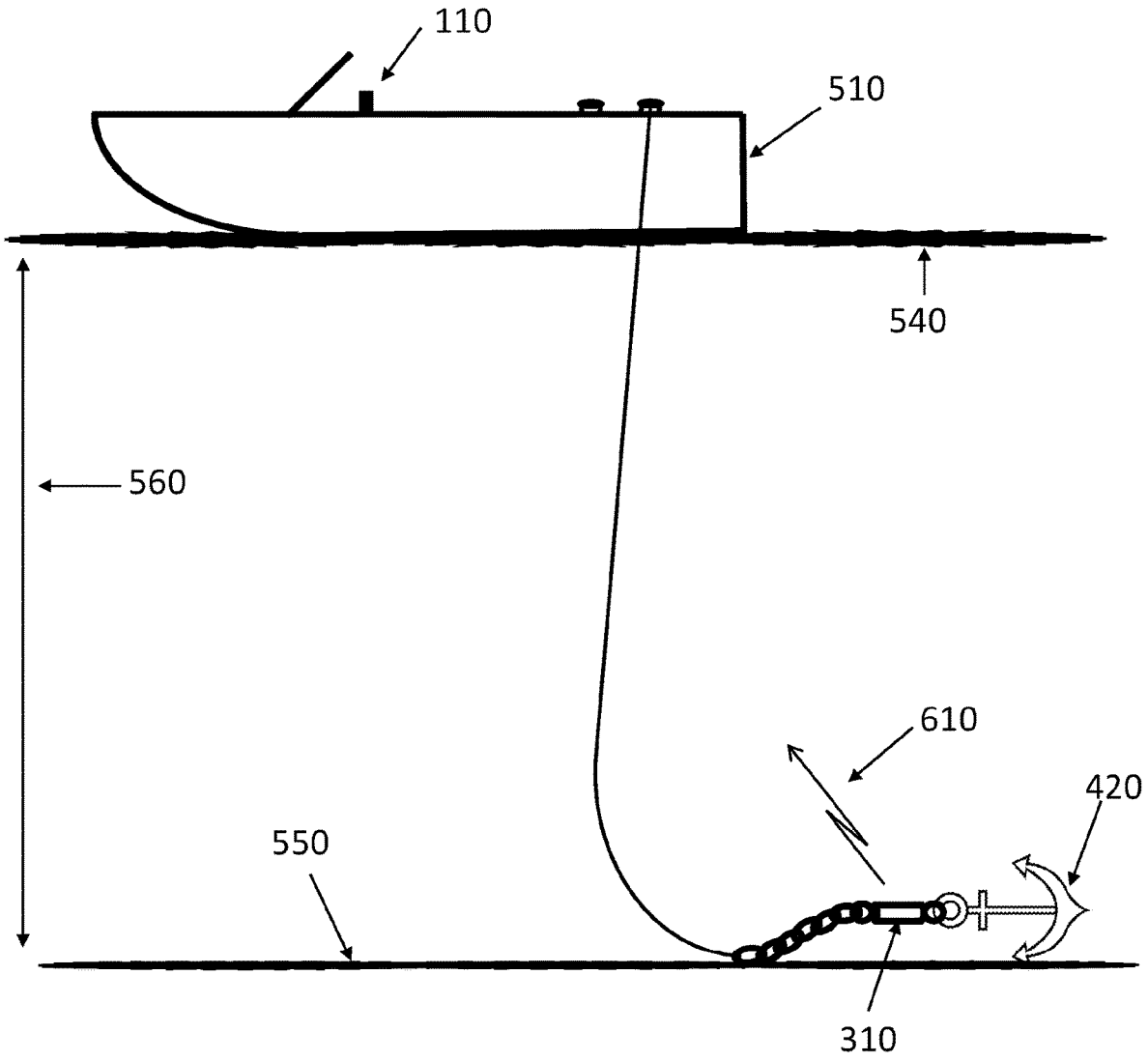
FIG. 7 depicts the boat anchor monitoring system showing the base module and anchor module deployed in deep water.
Figure 8:
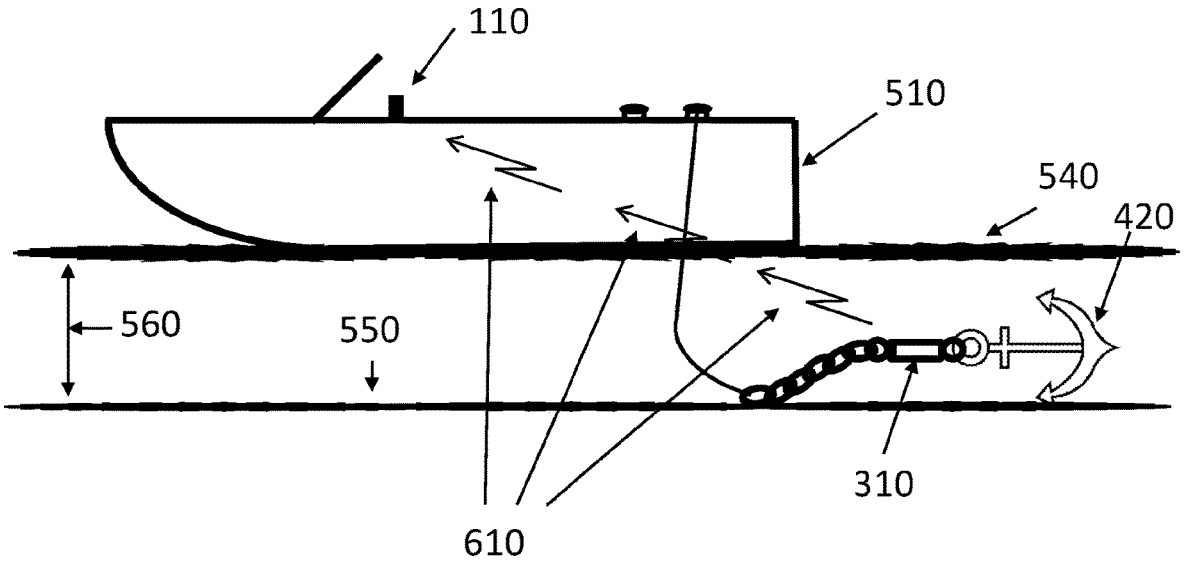
FIG. 8 depicts the boat anchor monitoring system showing the base module and anchor module deployed in shallow water.
Figure 9:
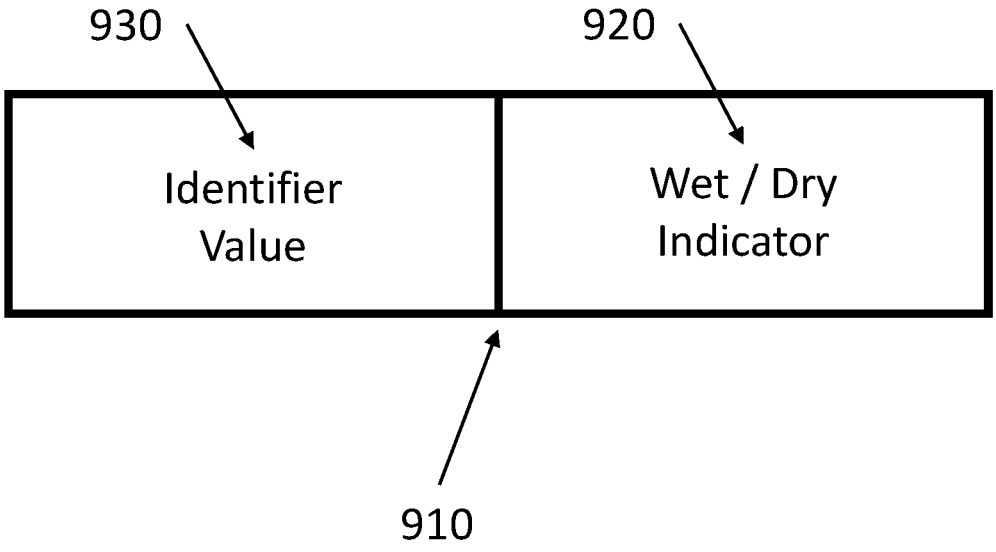
FIG. 9 depicts a data payload in accordance with an embodiment of the boat anchor monitoring system.

Turning to FIG. 5, the anchor module 310 may be connected between the anchor chain 570 and anchor 420 utilizing connecting rings 410 or affixed directly to the anchor 420 itself utilizing alternative connection means known in the art, including fasteners 440 that secure the anchor module 310 to the anchor 420. For purposes of this application, the term anchor chain 570 refers to a combination of rope 530 and metal chain 430. The anchor chain 570 may be affixed to the boat 510 via cleats 520. The size of the boat 510, bottom structure 550, depth of the water 560, and water surface conditions 540 all play a part in the choice of anchor type 420, rope 530 — metal chain 430 mix, and anchor chain 570 length.

Turning to FIG. 1, the base module 110 contains a power source 140 or power source connector 145, a processor 170, a receiver 120 capable of receiving the signal 610 from the anchor module 310, an RF signal strength measurement component 125, a status indicator 160, and an antenna 130. The processor 170 is operable to communicate with the receiver 120, the RF signal strength measurement component 125, and status indicator 160. The RF signal strength measurement component 125 is typically built into the functionality of the receiver 120 by the manufacturer, allowing signal strength measurement data to be communicated to the processor 170 when receiver data is communicated to the processor 170. The status indicator 160 may be a display, lights, or a buzzer (as examples). The status indicator 160 will indicate the states of "Not Deployed" or "Deployed".

In operation, the processor 350 within the anchor module 310 commands the anchor unit transmitter 320 to broadcast a signal 610 on a schedule. For example, a broadcast schedule could be 1 Hz. The signal 610 contains a data payload 910 that includes an identifier value 930 corresponding to the anchor module 310. The frequency of the signal 610 may be any of the many unlicensed frequencies available in the ISM bands, including for example, 433 MHz, 915 MHz, 2.4 GHz, and 5.8 GHz. The higher the frequency, the more the energy will be attenuated by the water. This attenuation value will be further increased due to a higher water salinity content (i.e., brackish or sea water).

Many modern transmitters 320 include the functionality of the processor 350 within the same component. For example, a transmitter 320 can be configured during production to automatically broadcast programmed data on a schedule. The programmed data can also include transmitter data modification during operation that is dependent on external stimuli to the transmitter; for example, sensor 360 data.

The processor 170 within the base module 110 is operable to receive the signal 610 transmitted by the anchor module 310 utilizing the receiver 120. Upon receipt of the signal 610, the processor 170 is configured to parse the data payload 910 and extract the identifier value 930 as well as determine the strength of the signal 610 utilizing RF signal strength measurement component 125. The identifier value 930 is a unique identifier that allows the base module 110 to know which anchor module 310 originated the signal 610 containing the data payload 910 that has been received and verify it is an anchor module 310 associated with the base module 110. If the signal strength is above or equal to a predetermined value programmed into the base module 110, the status indicator 160 is set to "Not Deployed" 210. If the signal strength is below the predetermined value programmed into the base module 110, the status indicator 160 is set to "Deployed" 220.

In yet another embodiment, as an additional safety measure, the base module 110 may include a timer 150 that is operable to communicate with the processor 170. If the timer 150 reaches a pre-programmed threshold time value, typically a multiple of the unit of time of the anchor module 310 signal schedule, and the processor 170 has not received a signal 610 utilizing the receiver 120 above or equal to the predetermined value programmed into the base module 110, the processor 170 commands the status indicator 160 to be set to "Deployed" 220. When the processor 170 receives a signal 610 above or equal to the predetermined value programmed into the base module 110, the timer 150 is reset and the processor 170 commands the status indicator 160 to be set to "Not Deployed" 210. In an exemplary embodiment, the preprogrammed threshold time value for the timer 150 is three times the preset schedule for the signal 610. Accordingly, if the signal 610 broadcasts on a 1 Hz schedule, the timer 150, upon reaching three seconds, will indicate loss of signal 610 and the processor 170 will direct the status indicator 160 to indicate a "Deployed" status 220. When the signal 610 is received by the base module 110 and the signal strength threshold exceeds or is equal to the predetermined value, the timer 150 is automatically reset and the processor 170 will direct the status indicator 160 to indicate a "Not Deployed" status 210. The signal strength threshold may be set at the minimum receive level of the receiver 120. This would cause any successful reception of the signal 610 to reset the timer 150 and cause a "Not Deployed" indication 210.

In an alternate embodiment, the anchor module 310 includes a sensor 360 configured to communicate with the processor 350 and operable to detect when the anchor 420 containing the sensor 360 is submerged in water. The sensor 360 is configured to be activated upon submersion in water. For example, the sensor 360 can be activated by water contact or may be pressure activated. An example sensor 360 can be two electrodes exposed to the environment and a few passive electronic components. Upon submersion in water, the processor 350 will detect that the sensor 360 has been activated and will modify the data payload 910 of the signal 610 by setting the wet/dry indicator 920 to "wet" (or active). In operation for this embodiment, when the signal 610 is detected by the receiver 120, the data payload 910 is parsed by the processor 170, allowing the base module 110 to determine the identifier value 930, the wet/dry indicator 920, and the signal strength. If the wet/dry indicator 920 indicates "wet," the processor directs the status indicator 160 be set to "Deployed" 220.

The addition of a sensor 360 or timer 150 in accordance with the embodiments above can be added to any embodiment described herein to provide added levels of safety. The addition of these safety measures ensures that a loss of sufficient signal 610 or direct indication of water submersion will cause the base module 110 to indicate a "Deployed" 220 status on the status indicator 160.

Figure 11:
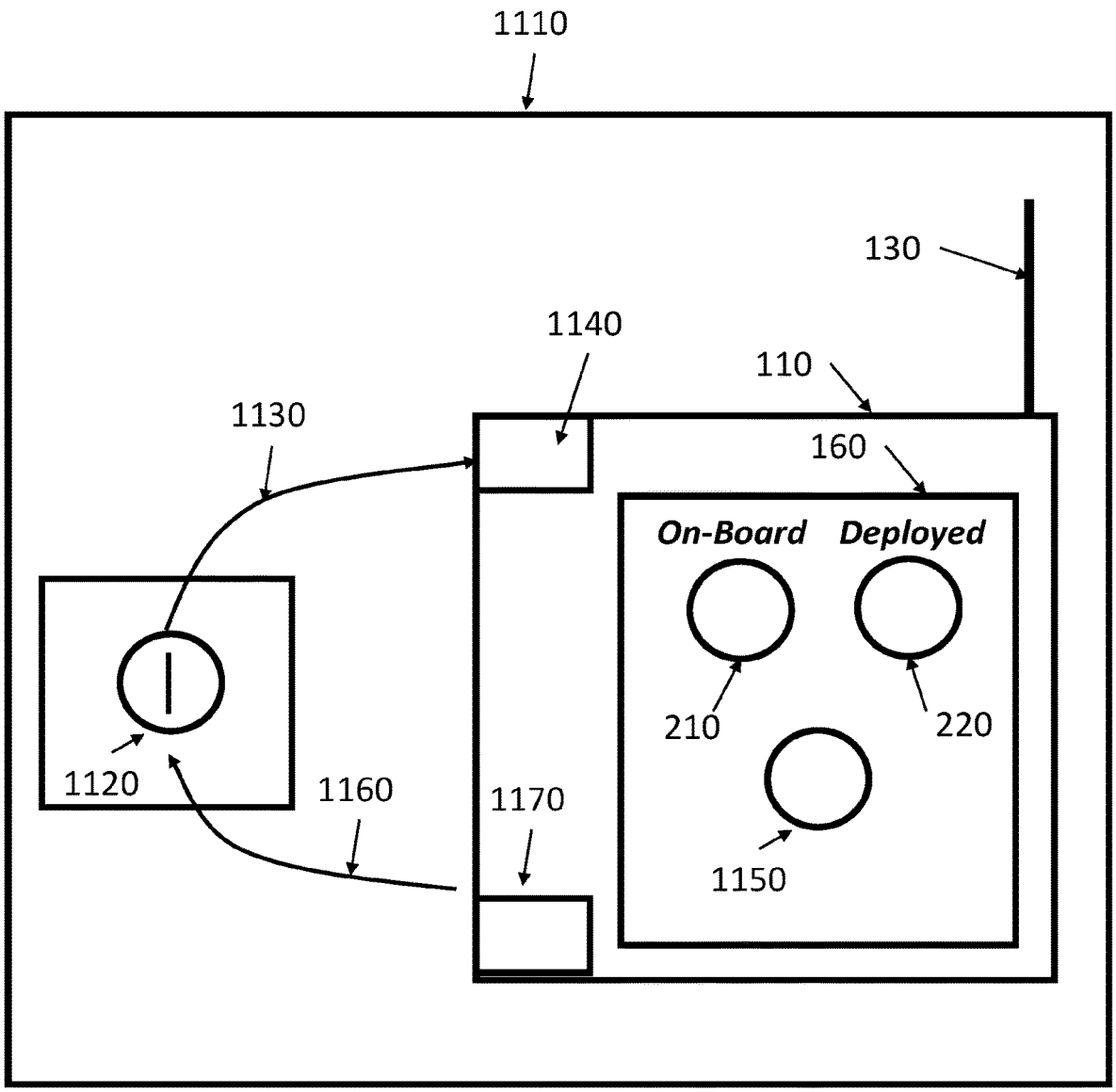
FIG. 11 depicts the boat anchor monitoring system showing the base module interfacing with the boat ignition system.

Turning to FIG. 11, in an alternate embodiment, the base module 110 is operable to communicate with the ignition system 1120 of the boat. The ignition system 1120 communicates via a signal 1130 to an input 1140 of the base module 110. The input signal 1130 is configured to indicate whether the boat ignition system is on or off. The input signal 1130 typically consists of a ground wire and a wire with a voltage level. Typically, if the voltage level is ground, the ignition system is not active. If the voltage level is above a specified threshold, the ignition system is active. The base module 110 includes a second indicator 1150, or alternatively, like the status indicator 160, is communicatively coupled to the base module 110. This second indicator 1150 may be a display, lights, or a buzzer (as examples). During operation for this embodiment, if the processor 170 is directing the status indicator 160 to indicate a "Deployed" state 220, and the input signal 1130 from the boat ignition system 1120 indicates the state of the boat ignition system 1120 is on, the second indicator 1150 is activated to warn the boat operator of a dangerous situation, i.e., potential boat movement with a deployed anchor.

In an alternative embodiment, the boat anchor monitoring system has the ability to prevent the ignition system from starting if the anchor is in the "Deployed" 220 state. For this embodiment, as shown in FIG. 11, the base module 110 additionally includes an output 1170 that transmits an output signal 1160. The output signal 1160 is configured to indicate the status of the anchor as either "deployed" or "not deployed." The output signal 1160 is communicatively connected to the ignition system 1120 of the boat and operable to prevent the ignition system 1120 from starting if the base module 110 indicates the anchor is "deployed." The output signal 1160 may consist of a wire pair consisting of signal and ground, where the signal wire drives a voltage level sufficient enough to activate sense circuitry within an ignition system if the capability has been designed into the ignition system by the manufacturer. The output signal 1160 may alternatively consist of a wire pair that the processor 170 can direct to be either electrically shorted together or electrically opened. The ignition wire is routed through these two wires. When electrically shorted, current is allowed to flow through the ignition wire, allowing the boat engine to operate. When electrically opened, current is not allowed to flow through the ignition wire, disabling the ability of the boat engine to operate. In this embodiment, the output signal 1160 can also be connected to another external indicator (not shown) alerting the user that the failed ignition attempt is due to the deployed state of the anchor.

Alternatively, the boat anchor monitoring system may further include a global positioning system (GPS) (not shown) and a second indicator 1150. The second indicator 1150 is operable to communicate with the base module 110 and the base module 110 is further operable to communicate with the GPS. GPS coordinates are provided to the processor 170 of the base module 110, which determines if the boat has moved a given distance. If the processor 170 determines the boat has moved a specified distance and the anchor is deployed, the processor will activate the second indicator 1150. Optionally, a motion detector (not shown) may be incorporated into the boat anchoring system in addition to, or in lieu of, the GPS. The base module 110 is operable to communicate with the motion detector and the motion detector is configured to record and transmit data regarding the movement of the boat to the base module 110. If the processor 170 determines the boat has moved a distance and the anchor is deployed, the processor 170 will activate the second indicator 1150.

Figure 12:
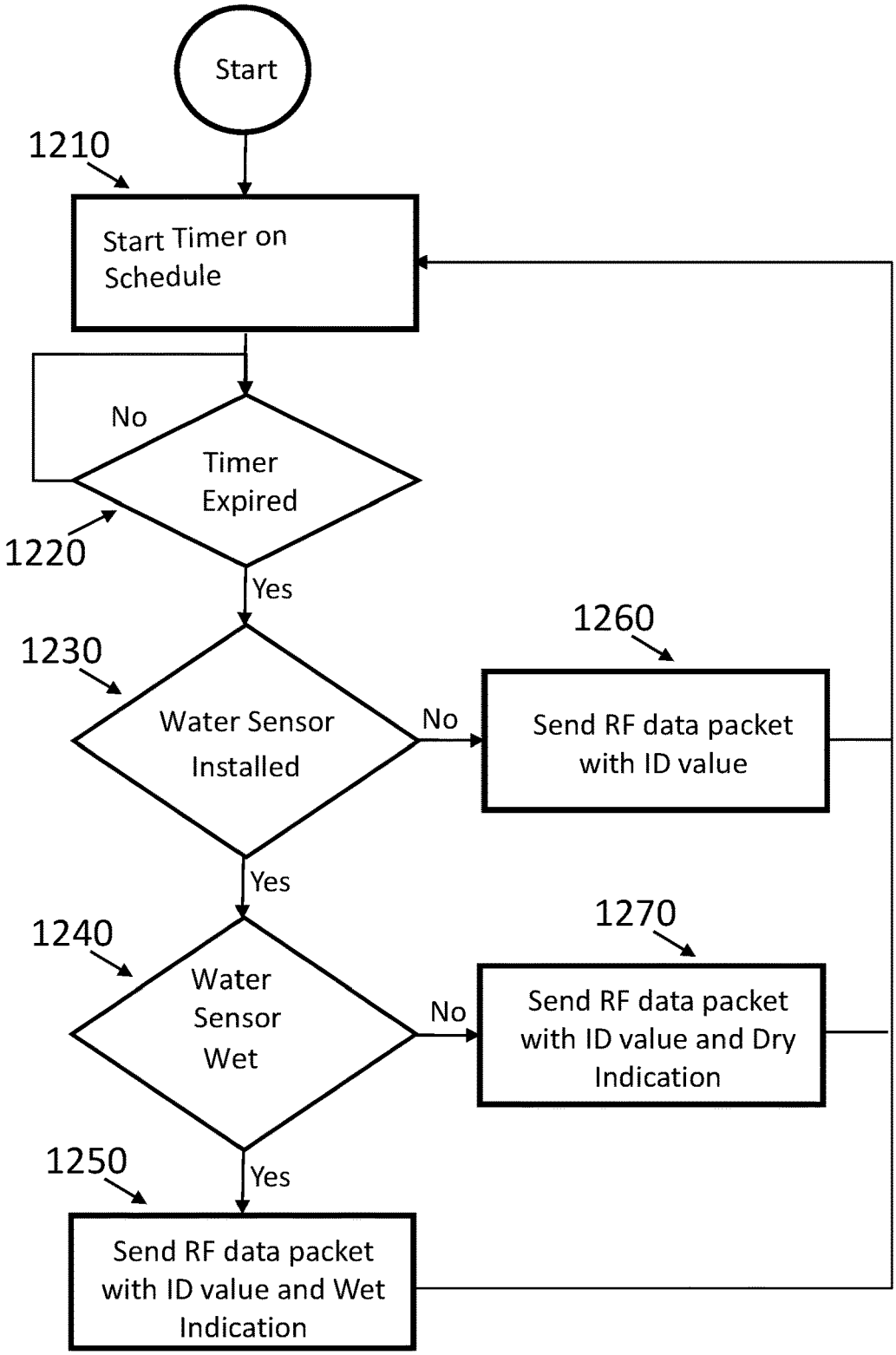
FIG. 12 depicts a flow diagram showing the processes performed by the anchor module in accordance with embodiments of the boat anchor monitoring system.

Turning to FIG. 12, a flow diagram showing the processes performed by the anchor module 310 in accordance with embodiments of the boat anchor monitoring system is presented. The process includes a first step 1210 of transmitting a signal on a timed schedule. When the time expires 1220, the next step 1230 depends on whether a sensor 360 is installed or not. If no sensor 360 is installed, the next step 1260 includes transmission via the transmitter 320 of a data payload 910 containing the identifier value 930 of the anchor module 310. After the data payload 910 is transmitted, the process is repeated beginning at step 1210. Returning to step 1230, if a sensor 360 is installed, the next step 1240 involves the sensor 360 determining whether water is detected. If the sensor 360 does not detect water, the next step 1270 involves the transmission of a data payload 910 containing the identifier value 930 of the anchor module 310 and a "dry" indication 920. After the data payload 910 is transmitted, the process restarts at step 1210. Returning to step 1240, if the sensor 360 detects water, the next step 1250 involves the transmission of a data payload 910 containing the identifier value 930 of the anchor module 310 and a "wet" indication 920. After the data payload 910 is transmitted, the process once again restarts at step 1210.

Figure 13:
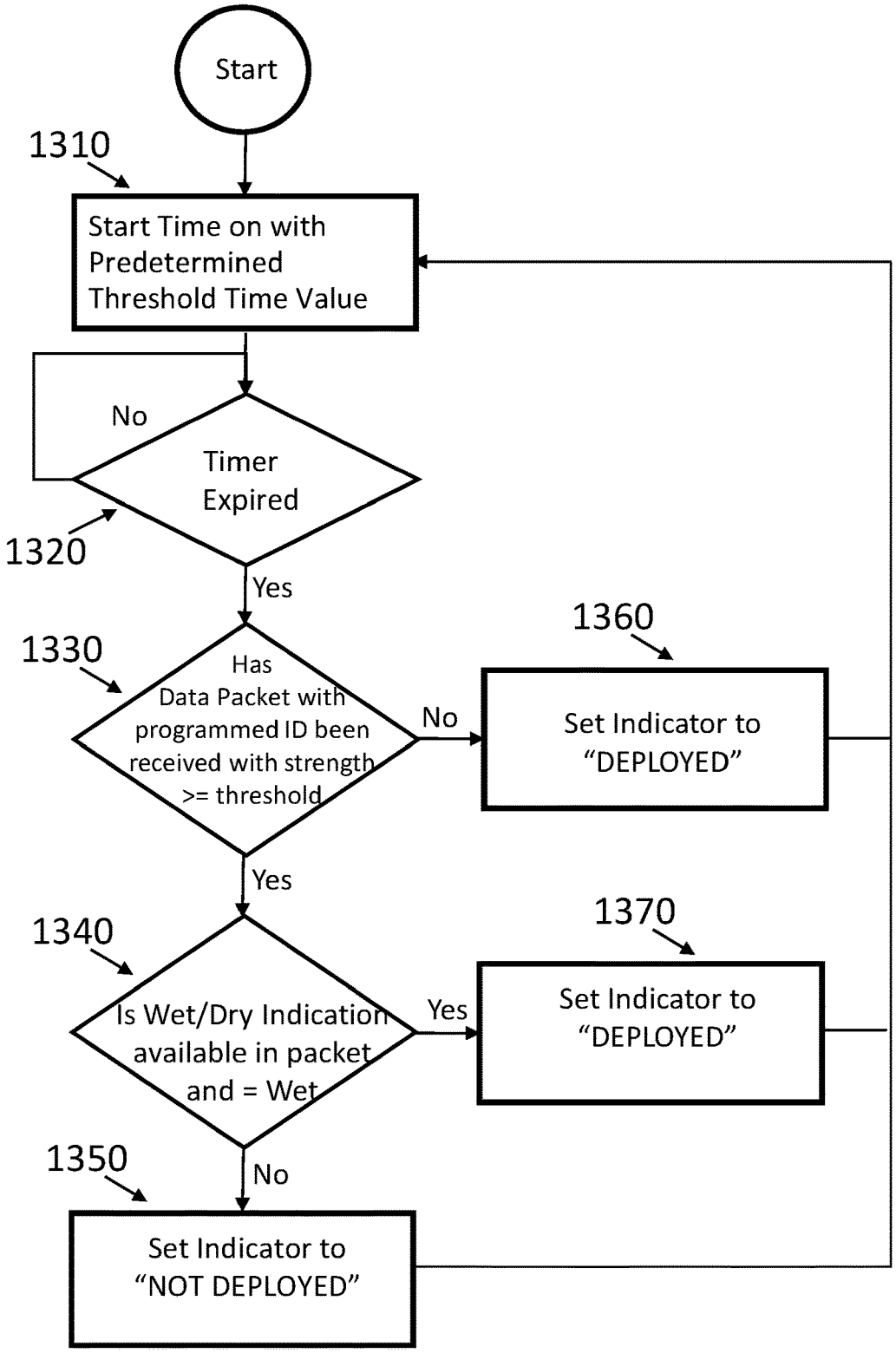
FIG. 13 depicts a flow diagram showing the processes performed by the base module in accordance with embodiments of the boat anchor monitoring system.

Turning to FIG. 13, a flow diagram showing the processes performed by the base module 110 in accordance with embodiments of the boat anchor monitoring system is presented. The process includes a first step 1310 of starting a timer 150. The timer 150 is set to a predetermined threshold time value, which typically is a multiple of the anchor module 310 signal schedule. When the timer 150 expires 1320, the next step 1330 depends on whether at least one data payload 910 with a preprogrammed identifier value 930 (from an anchor module 310 with matching identifier value 930) has been received with a signal strength greater than or equal to the required a predetermined value. If no data payloads 910 with a preprogrammed identifier value 930 have been received with a signal strength greater than or equal to the predetermined threshold value, the next step 1360 is for the status indicator 160 to be set to "deployed," as water submersion is not allowing sufficient signal to reach the base module 110. The process once again restarts at step 1310 and the timer 150 is reset. Returning to step 1330, if a data payloads 910 with a preprogrammed identifier value 930 have been received with a signal strength greater than or equal to the predetermined threshold value, the next step 1340 is determining if the wet/dry indication 920 from the sensor 360 is available in the data payload 910. If the wet/dry indicator 920 is available in the data payload 910 and set to "wet", the next step 1370 is to set the status indicator 160 to "Deployed" 220, as the anchor module 310 is submerged in water. The process once again restarts at step 1310 and the timer 150 is reset. Returning to step 1340, if the wet/dry indication 920 from the sensor 360 is either not available (feature not implemented in unit) or not set to wet (it is dry; not submerged) in the data payload 910, the next step 1350 is to set the status indicator 160 to "Not Deployed" 210, as the anchor module 310 is not submerged in water. The process once again restarts at step 1310 and the timer 150 is reset.

Figure 14:
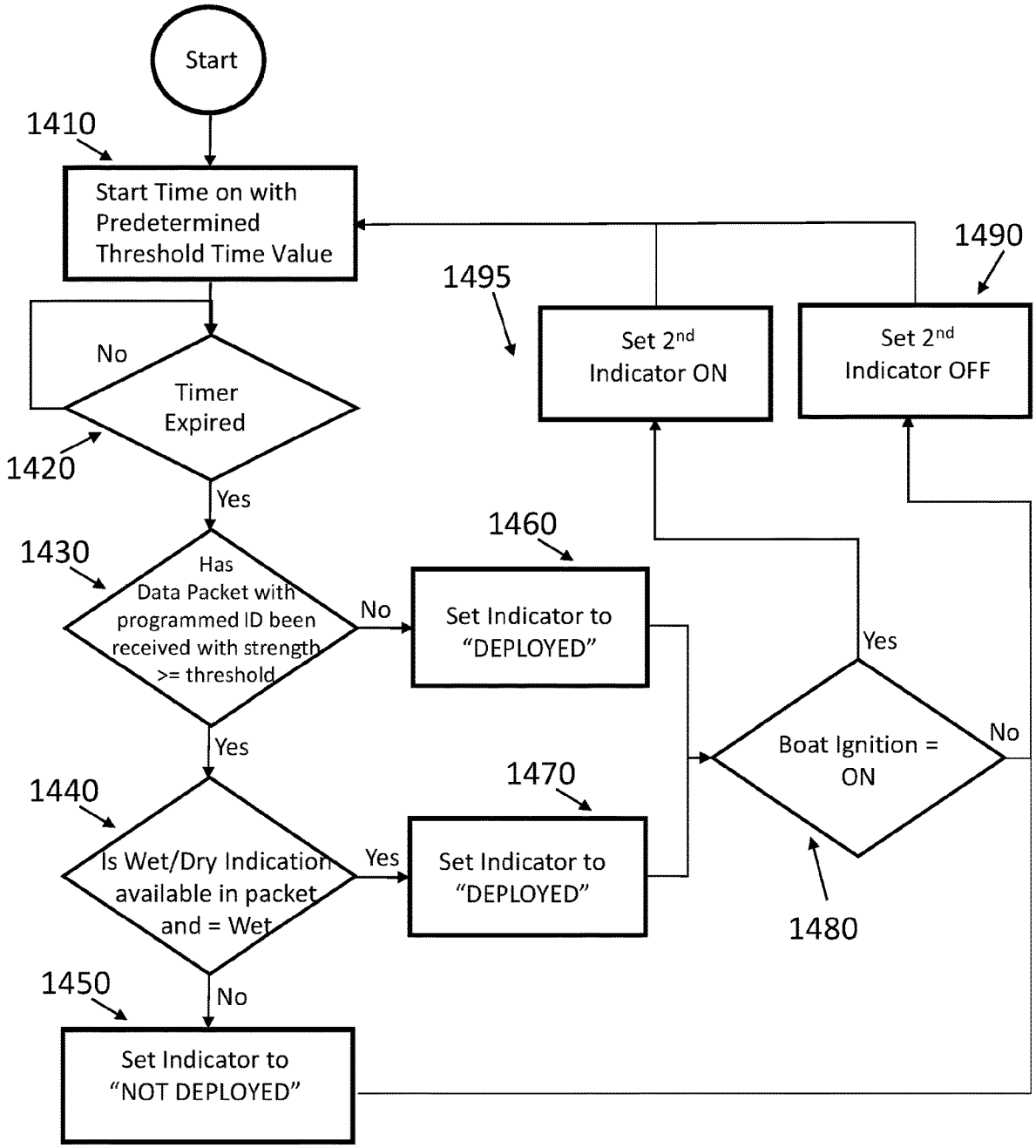
FIG. 14 depicts a flow diagram showing the processes performed by the base module with ignition system integration in accordance with embodiments of the boat anchor monitoring system.

Turning to FIG. 14, a flow diagram showing the processes performed by the base module 110 with ignition system 1120 integration in accordance with embodiments of the boat anchor monitoring system is presented. The process includes a first step 1410 of starting a timer 150 with a predetermined threshold time value. When the timer 150 expires in step 1420 by reaching the predetermined threshold time value, the next step 1430 depends on whether at least one data payload 910 with a preprogrammed identifier value 930 (from an anchor module 310 with matching identifier value 930) has been received with a signal strength greater than or equal to the predetermined threshold value. If no data payloads 910 with a preprogrammed identifier value 930 have been received with a signal strength greater than or equal to the predetermined threshold value, the next step 1460 involves setting the status indicator 160 to "Deployed" 220, as water submersion is not allowing sufficient signal to reach the base module 110. The boat ignition status input 1140 is then checked in the next step 1480. If the boat ignition is on, the next step 1495 involves setting the second indicator 1150 to an "on" position (likely an audible indicator) to warn the boat operator of a dangerous situation. The process once again restarts at step 1410 and the timer 150 is reset. Returning to step 1480, if the boat ignition is off, the next step 1490 involves setting the second indicator 1150 to an "off" position as there is no danger of boat movement, thus no need to warn the boat operator. The process then restarts at step 1410 and the timer 150 is reset. Returning to step 1430, if data payloads 910 with a preprogrammed identifier value 930 have been received with a signal strength greater than or equal to the predetermined value, the next step 1440 is determining if the wet/dry indication 920 from the sensor 360 is available in the data payload 910. If the wet/dry indication 920 is available in the data payload 910 and it is set to "wet," the next step 1470 is to set the status indicator 160 to "Deployed" 220, as the anchor module 310 is submerged in water. The boat ignition status input 1140 is then checked in step 1480. If the boat ignition is on, the next step 1495 is to set the second indicator 1150 to "on" (likely an audible indicator) to warn the boat operator of a dangerous situation. The process then restarts at step 1410 and the timer 150 is reset. If the boat ignition is off 1480, the next step 1490 is to set the second indicator 1150 to "off" as there is no danger of boat movement. The process then restarts at step 1410 and the timer 150 is reset. Returning to step 1440, if the wet/dry indication 920 is either not available (feature not implemented in unit) or not set to "wet" (it is dry; not submerged) in the data payload 910, the status indicator 160 is set to "Not Deployed" 210, and second indicator 1150 is set to "off" as there is no danger of boat movement with a submerged anchor; the anchor is not in the water. The process then restarts at step 1410 and the timer 150 is reset.

For any of the embodiments, multiple anchor modules 310 may be deployed provided each anchor module 310 is configured with its own identifier value 930. When multiple anchor modules 310 are used, the processor 170 within the base module 110 is configured with the identifier values 930 of each of the associated anchor modules 310. The base module 110 may be configured to include a status indicator 160 for each of the anchor modules 310. For this embodiment, each of the anchor modules 310 and the base module 110 comprise the same elements as the aforementioned embodiments and are operable to communicate with each other in the same manner.

The processor 170 within the base module 110 configures the receiver 120 within the base module 110 to detect the individual signals 610 being transmitted by all associated anchor modules 310. Each signal 610 contains a data payload 910 comprising the identifier value 930. For embodiments that contain a sensor 360 operable to detect when the anchor 420 containing the sensor 360 is submerged in water, the data payload 910 includes a wet/dry indicator 920. When a signal 610 is detected by the receiver 120 and the processor 170 determines that the received signal strength of the signal 610 is above or equal to a predetermined value, the data payload 910 is parsed by the processor 170. The identifier value 930 is extracted and the identifier value 930 is logged. If the identifier value 930 matches the identifier value 930 that has been configured into the anchor module 310 and base module 110, the status indicator 160 associated with the specific anchor module 310 is set to "Not Deployed" 210, and for embodiments that include a timer 150, the timer 150 associated with the specific anchor module 310 is reset. If the timer 150 reaches a pre-programmed threshold time value, typically a multiple of the anchor module signal schedule, and the processor 170 has not received a signal 610 above or equal to the predetermined value, the processor 170 commands the status indicator 160 to be set to "Deployed" 220. For embodiments that include a water sensor 360, if the wet/dry indicator 920 indicates "wet," the processor directs the status indicator 160 be set to "Deployed" 220.

Alternatively, for embodiments that include only one status indicator 160, if the timer 150 associated with any of the associated anchor modules 310 reaches a pre-programmed value, or the sensor 920 of any of the associated anchor modules 310 determines that the anchor is submerged, the status indicator 160 will be set to "Deployed" 220, indicating that at least one of the anchors is deployed. Likewise, the base module 110 is operable to communicate with the ignition system 1120 and prevent the ignition system 1120 from starting or alert the operator via a second indicator 1150 if it is determined that any of the associated anchor modules 310 are deployed, as described in the prior embodiments.

For the purposes of promoting an understanding of the principles of the invention, reference has been made to the embodiments illustrated in the drawings, and specific language has been used to describe these embodiments. However, this specific language intends no limitation of the scope of the invention, and the invention should be construed to encompass all embodiments that would normally occur to one of ordinary skill in the art. The implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A boat anchor monitoring system comprising:

a status indicator operable to signal the position of a boat anchor as deployed or not deployed, an anchor module coupled to the boat anchor and comprising a transmitter, wherein the transmitter is operable to transmit a signal on a schedule, wherein the signal comprises a data payload having an identifier value corresponding to the anchor module, a base module comprising a processor and a receiver, wherein the processor is operable to communicate with the receiver and the status indicator, wherein the receiver is operable to receive the signal from the transmitter, wherein the processor is operable to determine the strength of the signal and compare the strength of the signal to a predetermined value, wherein, when the strength of the signal exceeds, or is equal to the predetermined value, the processor determines the anchor is not deployed and directs the status indicator to display the anchor in the not deployed position, wherein, when the strength of the signal is less than the predetermined value, the processor determines the anchor is deployed and directs the status indicator to display the anchor in the deployed position.

2. The boat anchor monitoring system of claim 1, wherein the predetermined value is equivalent to a minimum value required for the signal to be detected.

3. The boat anchor monitoring system of claim 1, comprising a timer, wherein the processor of the base module is operable to communicate with the timer, wherein the timer is automatically reset by the processor when the strength of the signal exceeds or is equal to the predetermined value, wherein the processor directs the status indicator to display the anchor in the not deployed position when the strength of the signal exceeds or is equal to the predetermined value, wherein, if the timer reaches a threshold time value, the processor directs the status indicator to display the anchor in the deployed position.

4. The boat anchoring monitoring system of claim 3, wherein the threshold time value is a multiple of the unit of time for the schedule.

5. The boat anchoring monitoring system of claim 3, where scheduled frequency is 1 second and the threshold time value is 3 seconds.

6. The boat anchor monitoring system of claim 1, wherein the anchor module further comprises a sensor operable to detect the presence of water, wherein the sensor is operable to communicate with the transmitter of the anchor module, wherein the sensor is activated when water is detected, wherein the data payload of the signal includes a water contact state indication, wherein, when the sensor is activated, the water contact state indication is set to active, wherein, when the base module receives the signal with the water contact state indication set to active, the processor directs the status indicator to display the anchor in the deployed position.

7. The boat anchor monitoring system of claim 1, comprising a second indicator operable to communicate with the base module, wherein the base module is further operable to communicate with an ignition system for the boat, wherein the processor of the base module is operable to determine if the ignition system is activated, wherein, if the processor determines the ignition system is activated and the anchor is deployed, the processor will activate the second indicator.

8. The boat anchor monitoring system of claim 7, wherein the base module is operable to prevent activation of the ignition system if the processor determines the anchor is deployed.

9. The boat anchor monitoring system of claim 1, comprising a global positioning system and a second indicator, wherein, the second indicator is operable to communicate with the base module, wherein the base module is further operable to communicate with the global positioning system, wherein the processor of the base module is operable to receive global positioning system coordinates from the global positioning system and determine if the boat has moved a distance, wherein, if the processor determines the boat has moved a distance and the anchor is deployed, the processor will activate the second indicator.

10. The boat anchor monitoring system of claim 1, comprising a motion detector and a second indicator operable to communicate with the base module, wherein the base module is operable to communicate with the motion detector, wherein the processor of the base module is operable to receive values from the motion detector and determine if the boat has moved a distance, wherein, if the processor determines the boat has moved a distance and the anchor is deployed, the processor will activate the second indicator.

11. The boat anchor monitoring system of claim 1, comprising a plurality of anchor modules coupled to separate anchors, wherein, if the base module determines any one of the plurality of anchors is deployed, the processor of the base module directs the status indicator to display the anchor in the deployed position.

12. A boat anchor monitoring system comprising:

a status indicator operable to signal the position of a boat anchor as deployed or not deployed, an anchor module coupled to the boat anchor and comprising a transmitter and a sensor, wherein the sensor is operable to communicate with the transmitter of the anchor module and is further operable to detect the presence of water, wherein the sensor is activated when water is detected, wherein the transmitter is operable to transmit a signal comprising a data payload on a schedule, wherein the data payload of the signal comprises an identifier value corresponding to the boat anchor and a water contact state indication, wherein, when the sensor is activated, the water contact state indication is set to active, a base module comprising a processor and a receiver, wherein the processor is operable to communicate with the receiver and the status indicator, wherein the receiver is operable to receive the signal from the transmitter, wherein the processor is operable to determine the strength of the signal and compare the strength of the signal to a predetermined value, a timer, wherein the processor of the base module is operable to communicate with the timer, wherein, when the base module receives the signal with the water contact state indication set to active, the processor directs the status indicator to display the anchor in the deployed position, wherein, when the base module receives the signal with the water contact state indication set to inactive and the signal strength exceeds, or is equal to the predetermined value, the timer is automatically reset by the processor and the processor directs the status indicator to display the anchor in the not deployed position, wherein, if the timer reaches a threshold time value, the processor directs the status indicator to display the anchor in the deployed position.

13. The boat anchor monitoring system of claim 12, wherein the predetermined value is equivalent to a minimum value required for the signal to be detected by the receiver.

14. The boat anchor monitoring system of claim 12, wherein the threshold time value is a multiple of the unit of time for the schedule.

15. The boat anchor monitoring system of claim 12, comprising a second indicator operable to communicate with the base module, wherein the base module is further operable to communicate with an ignition system for the boat, wherein the processor of the base module is operable to determine if the ignition system is activated, wherein, if the processor determines the ignition system is activated and the anchor is deployed, the processor will activate the second indicator.

16. The boat anchor monitoring system of claim 15, wherein the base module is operable to prevent activation of the ignition system if the processor determines the anchor is deployed.

17. The boat anchor monitoring system of claim 12, comprising a plurality of anchor modules coupled to separate anchors, wherein, if the base module determines any one of the plurality of anchors is deployed, the processor of the base module directs the status indicator to display the anchor in the deployed position.

18. A boat anchor monitoring system comprising:

a status indicator operable to signal the position of a boat anchor as deployed or not deployed, an anchor module coupled to the boat anchor and comprising a transmitter, wherein the transmitter is operable to transmit a signal on a schedule, wherein the signal comprises a data payload having an identifier value corresponding to the boat anchor, a base module comprising a processor and a receiver, wherein the processor is operable to communicate with the receiver and the status indicator, wherein the receiver is operable to receive the signal from the transmitter, wherein the processor is operable to determine the strength of the signal and compare the strength of the signal to a predetermined value, a timer, wherein the processor of the base module is operable to communicate with the timer, wherein, when the strength of the signal exceeds, or is equal to the predetermined value, the processor determines the anchor is not deployed and the timer is automatically reset by the processor and the processor directs the status indicator to display the anchor in the not deployed position, wherein, if the timer reaches a threshold time value, the processor directs the status indicator to display the anchor in the deployed position, wherein the base module is further operable to communicate with an ignition system for the boat, wherein the processor of the base module is operable to determine if the ignition system is activated, wherein, if the processor determines the ignition system is activated and the anchor is deployed, the processor will activate a second indicator.

19. The boat anchor monitoring system of claim 18, wherein the predetermined value is equivalent to a minimum value required for the signal to be detected.

20. The boat anchoring monitoring system of claim 18, wherein the threshold time value is a multiple of the unit of time for the schedule.

21. The boat anchor monitoring system of claim 18, wherein the anchor module further comprises a sensor operable to detect the presence of water, wherein the sensor is in communication with the transmitter of the anchor module, wherein the sensor is activated when the sensor detects water, wherein the signal data payload includes a water contact state indication, wherein, when the water sensor is activated, the water contact state indication is set to active, wherein, when the base unit receives the signal with the water contact state indication set to active, the processor directs the status indicator to display the anchor in the deployed position.

22. The boat anchor monitoring system of claim 18, wherein the base module is operable to prevent activation of the ignition system if the processor determines the anchor is deployed.

23. The boat anchor monitoring system of claim 18, comprising a plurality of anchor modules coupled to separate anchors, wherein, if the base module determines any one of the plurality of anchors is deployed, the processor of the base module directs the status indicator to display the anchor in the deployed position.

* * * * *